US007588304B2

(12) United States Patent
Kasai et al.

(10) Patent No.: US 7,588,304 B2
(45) Date of Patent: Sep. 15, 2009

(54) LIQUID DISCHARGE HEAD SUBSTRATE, LIQUID DISCHARGE HEAD, AND LIQUID DISCHARGE APPARATUS

(75) Inventors: Ryo Kasai, Setagaya-ku (JP); Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 352 days.

(21) Appl. No.: 11/739,421

(22) Filed: Apr. 24, 2007

(65) Prior Publication Data

US 2007/0296745 A1 Dec. 27, 2007

(30) Foreign Application Priority Data

Jun. 26, 2006 (JP) ..... 2006-175569

(51) Int. Cl.
*B41J 29/38* (2006.01)

(52) U.S. Cl. ..... 347/12

(58) Field of Classification Search ..... 347/5, 347/9, 10, 12

See application file for complete search history.

(56) References Cited

U.S. PATENT DOCUMENTS

2005/0134620 A1 6/2005 Hirayama

FOREIGN PATENT DOCUMENTS

JP 11-245409 A 9/1999

*Primary Examiner*—Julian D Huffman
(74) *Attorney, Agent, or Firm*—Canon USA Inc. IP Div

(57) ABSTRACT

A liquid discharge head substrate includes a plurality of recording elements, shift registers configured to serially receive input recording signals for driving the plurality of recording elements, latch circuits configured to hold in parallel the recording signals input to the shift registers, and drive circuits configured to drive the plurality of recording elements based on signals output from the latch circuits. The latch circuits, the drive circuits, a recording element array including the plurality of recording elements, and a supply port adapted to supply liquid to the plurality of recording elements are disposed on each side of the shift registers in order from the shift registers.

8 Claims, 12 Drawing Sheets

LIQUID DISCHARGE HEAD SUBSTRATE, LIQUID DISCHARGE HEAD, AND LIQUID DISCHARGE APPARATUS

BACKGROUND OF THE INVENTION

1. Field of the Invention

The present invention relates to a liquid discharge head substrate, a liquid discharge head, and a liquid discharge apparatus. More particularly, the present invention relates to a circuit configuration and a circuit layout of a liquid discharge head substrate having a multi-ink channel capable of supplying a plurality of kinds of liquid (e.g., ink) to the same liquid discharge head substrate.

2. Description of the Related Art

Liquid discharge apparatuses are configured to record information on a recording medium by discharging recording ink from a plurality of fine discharge ports of a liquid discharge head according to a recording signal. The liquid discharge apparatuses have advantages of non-contact printing onto recording media, such as paper, easy colorization, and silent operation.

An inkjet method for performing recording utilizing thermal energy is described below as an example of the liquid discharge method. The liquid discharge head used for the inkjet method is provided with recording elements (e.g., heaters) corresponding to discharge ports, from which liquid such as ink is discharged. Electric current is applied to the heaters to cause the heaters to generate heat. Thus, ink is heated to discharge ink droplets for recording.

To obtain a higher-resolution recorded image, it is desired that the number of heaters is increased, and that the heaters are disposed at a high density in the liquid discharge head. Also, to reduce costs of recording heads, it is desired that inkjet head substrates (hereunder referred to as element substrates), on each of which heaters and circuits are provided, are miniaturized. Generally, a semiconductor wafer is used as an element substrate. Accordingly, to reduce the cost of the element substrate, it is useful to reduce the area of an element substrate to increase the number of element substrates that can be produced from a single wafer.

A method for reducing the increase of the area of an element substrate even when the number of recording elements increases is discussed in U.S. Patent Application Publication No. US 2005/0134620 A1. FIG. 9 illustrates a circuit diagram of a heater array (array of heaters) 110 discussed in U.S. Patent Application Publication No. US 2005/0134620 A1. FIG. 10 illustrates a layout of an element substrate discussed also in U.S. Patent Application Publication No. US 2005/0134620 A1. According to the method discussed in U.S. Patent Application Publication No. US 2005/0134620 A1, at least one of an element selection circuit and a driving selection circuit is disposed adjacent to a driving circuit of each group having a predetermined number of adjacent recording elements. More specifically, a latch circuit 104, which holds recording data with the bit number corresponding to the number of groups to be time-division driven, and a shift register 105 are disposed adjacent to logic circuits 114 of each of the groups corresponding to each heater array 110, so that sets of the latch circuit 104 and the shift register 105 are arranged to extend in the longitudinal direction of an ink supply port 109.

Furthermore, Japanese Patent Application Laid-Open No. 11-245409 discusses a method for reducing the number of drive circuits to one-half of the number of arrays of heating elements by causing a single drive circuit, which is connected in parallel to two adjacent arrays of heating elements, to perform time-division driving of the two adjacent arrays of heating elements, thus miniaturizing a recording head.

The method discussed in U.S. Patent Application Publication No. US 2005/0134620 A1 can implement a liquid discharge head capable of high-quality recording with a multi-ink channel configuration obtained by providing a plurality of ink supply ports in an element substrate. However, circuits, such as shift registers, are disposed corresponding to each heater array along the longitudinal direction of an ink supply port. Consequently, there is a limit to reduction in the distance between adjacent ink supply ports.

On the other hand, according to the method discussed in Japanese Patent Application Laid-Open No. 11-245409, adjacent two heater arrays are driven by a single drive circuit and drive signals for a single heater array. With this configuration, the adjacent two heater arrays cannot simultaneously be driven. Consequently, it is difficult to concurrently implement both high-speed recording and high-quality recording.

SUMMARY OF THE INVENTION

The present invention is directed to providing a high-quality low-cost liquid discharge head substrate.

According to an aspect of the present invention, a liquid discharge head substrate includes a plurality of recording elements, shift registers configured to serially receive input recording signals for driving the plurality of recording elements, latch circuits configured to hold in parallel the recording signals input to the shift registers, and drive circuits configured to drive the plurality of recording elements based on signals output from the latch circuits. The latch circuits, the drive circuits, a recording element array including the plurality of recording elements, and a supply port adapted to supply liquid to the plurality of recording elements are disposed on each side of the shift registers in order from the shift registers.

According to an exemplary embodiment of the present invention, in a circuit configuration for driving recording elements, the function of a shift register is shared by two recording element arrays disposed between a pair of adjacent supply ports. Thus, the absolute number of circuit elements can be decreased. Consequently, the area of an element substrate can be reduced.

Also, according to an exemplary embodiment of the present invention, a latch circuit relating to driving of recording elements disposed between a pair of adjacent supply ports is provided for each recording element array to enable simultaneous driving of adjacent recording element arrays. Consequently, the cost of each element substrate can be reduced while a functional circuit configured to enhance image quality is provided on the surface of an element substrate.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 6:
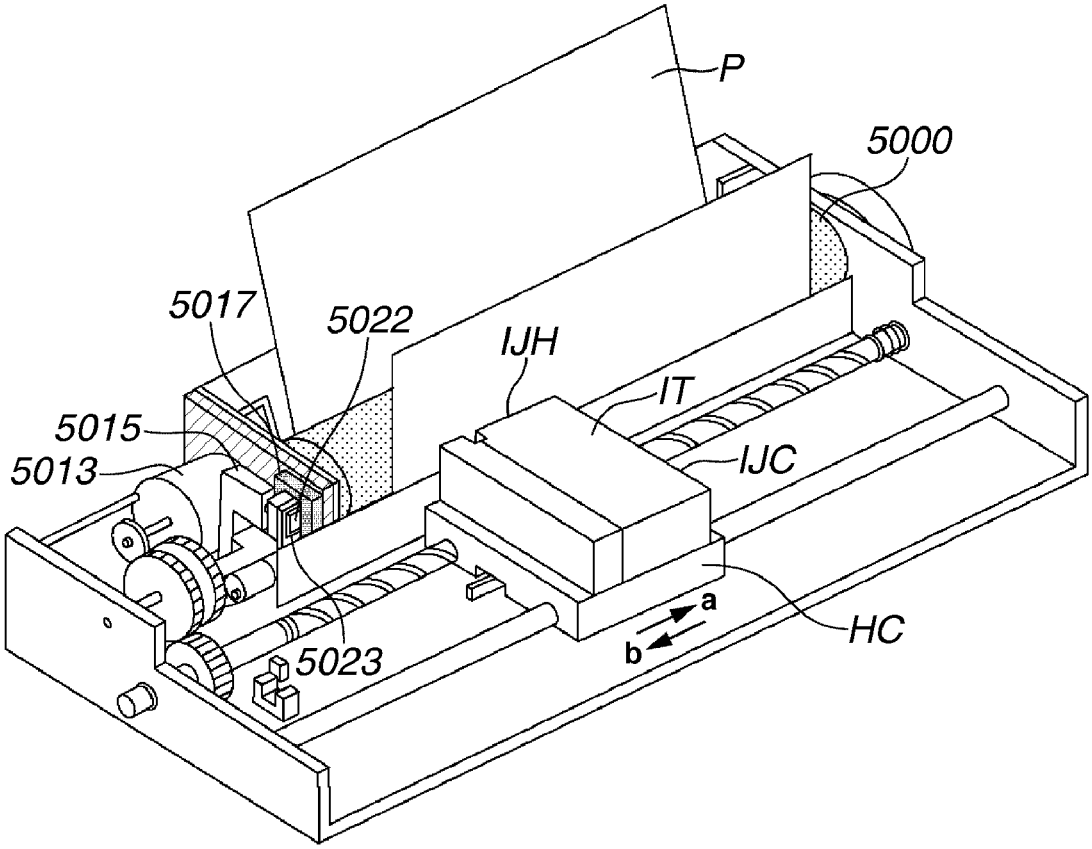
FIG. 6 is a perspective view illustrating a liquid discharge apparatus according to an exemplary embodiment of the present invention.

FIG. 6 is a perspective view illustrating a liquid discharge apparatus according to an exemplary embodiment of the present invention. As illustrated in FIG. 6, a carriage HC, on which an inkjet cartridge IJC is mounted, can be moved in both directions of arrows a and b by a carriage motor 5013. The inkjet cartridge IJC includes a liquid discharge head IJH and a tank IT. The tank IT stores liquid to be discharged from the liquid discharge head IJH. A platen 5000 conveys recording paper (or recording medium) P. A suction unit 5015 sucks the inside of a cap member 5022, which caps a front face of the liquid discharge head IJH, through an opening 5023. Thus, the suction unit 5015 performs a recovery operation of the liquid discharge head IJH. The liquid discharge apparatus also includes a cleaning blade 5017.

Figure 8:
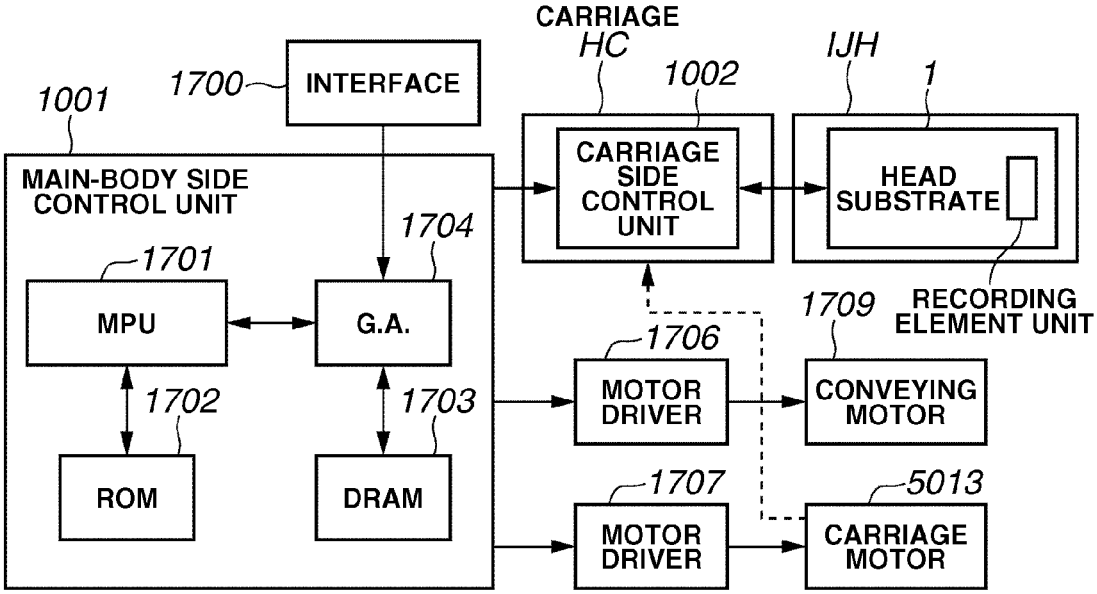
FIG. 8 is a block diagram illustrating a configuration of a control circuit of the liquid discharge apparatus according to an exemplary embodiment of the present invention.

FIG. 8 is a block diagram illustrating a configuration of a control circuit of the liquid discharge apparatus. As illustrated in FIG. 8, a main-body side control unit 1001 of the liquid discharge apparatus is connected to an interface 1700, through which a recording signal is input to the control unit 1001. The main-body side control unit 1001 includes a micro processing unit (MPU) 1701, a read-only memory (ROM) 1702 configured to store a control program to be executed by the MPU 1701, a dynamic random access memory (DRAM) 1703 configured to store various data (e.g., the recording signal, and recording data to be supplied to the liquid discharge head), and a gate array (G. A.) 1704, which controls supplying the recording data to the liquid discharge head IJH and which also controls data transfer among the interface 1700, the MPU 1701, and the DRAM 1703.

The control circuit of the liquid discharge apparatus also includes a conveying motor 1709 (not shown in FIG. 6) configured to convey recording paper P, a motor driver 1706 configured to drive the conveying motor 1709, and a motor driver 1707 configured to drive a carriage motor 5013.

When a recording signal is input to the interface 1700, the recording signal is converted into print recording data by the gate array 1704 and the MPU 1701. Then, the motor drivers 1706 and 1707 are driven. Also, the liquid discharge head IJH is driven according to recording data sent to the carriage HC. Thus, an image is recorded on the recording paper P.

To perform an optimal drive operation when driving a recording element unit of the liquid discharge head IJH, characteristic information stored in a memory of the element substrate 1 is referred to, so that a driving mode of each of the recording elements is determined.

The main-body side control unit 1001 does not directly control driving of the element substrate 1. The main-body side control unit 1001 controls driving of the element substrate 1 via a carriage side control unit 1002 mounted on the carriage HC.

The element substrate 1 is of the multi-ink channel type configured so that a single substrate is provided with a plurality of supply ports and with heater arrays of a plurality of heaters disposed along both sides of the supply ports. The use of such a substrate enables a reduction in the mounting burden due to a decrease in the number of substrates, a reduction in the number of input signals and in the area of the substrate due to sharing of drive circuit signals of a plurality of heater arrays, and a reduction in the area of the substrate due to sharing of circuit functions.

Figure 7:
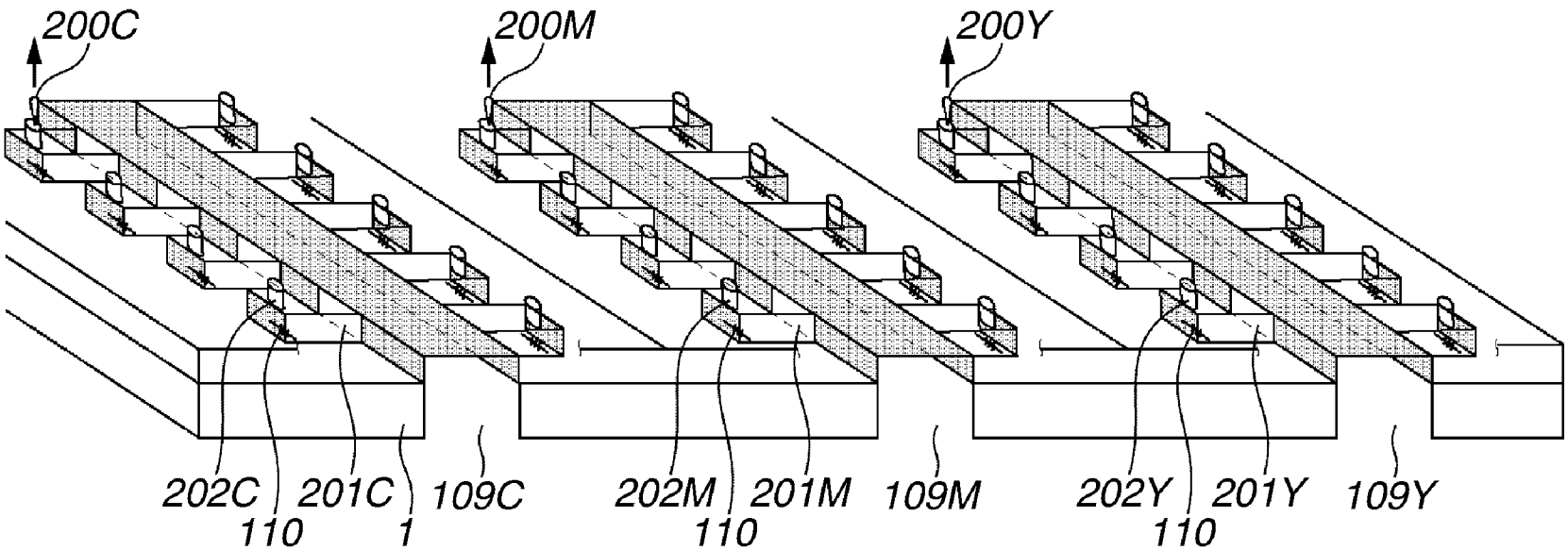
FIG. 7 is a perspective view illustrating a liquid discharge head according to an exemplary embodiment of the present invention.

FIG. 7 is a perspective view illustrating a three-dimensional structure of the liquid discharge head IJH, which is configured to discharge three color inks, according to an exemplary embodiment of the present invention.

The liquid discharge head IJH has a supply port 109C adapted to supply cyan (C) ink, a supply port 109M adapted to supply magenta (M) ink, and a supply port 109Y adapted to supply yellow (Y) ink. Also, the liquid discharge head IJH has supply paths (not shown) adapted to respectively supply C ink, M ink, and Y ink from the tank IT to the supply ports 109C, 109M, and 109Y through the rear surface side of the element substrate 1.

C ink, M ink, and Y ink are supplied through the supply ports 109C, 109M, and 109Y to the recording elements (hereunder referred to as the heaters) 110 provided on the element substrate 1 through the ink flow paths 201C, 201M, and 201Y communicating with the supply ports 109C, 109M, and 109Y, respectively. When the heaters 110 are energized through a circuit (to be described later), heat is applied to the ink put on the heaters 110. Then, ink droplets 200C, 200M, and 200Y are discharged from discharge ports 202C, 202M, and 202Y due to generated foams.

The liquid discharge head substrate 1 illustrated in FIG. 7 is used as a substrate on which recording elements, various circuits for driving the recording elements, a memory, various pads serving as electrical contacts with the carriage HC, and various signal lines are to be formed.

First Exemplary Embodiment

Figure 1:
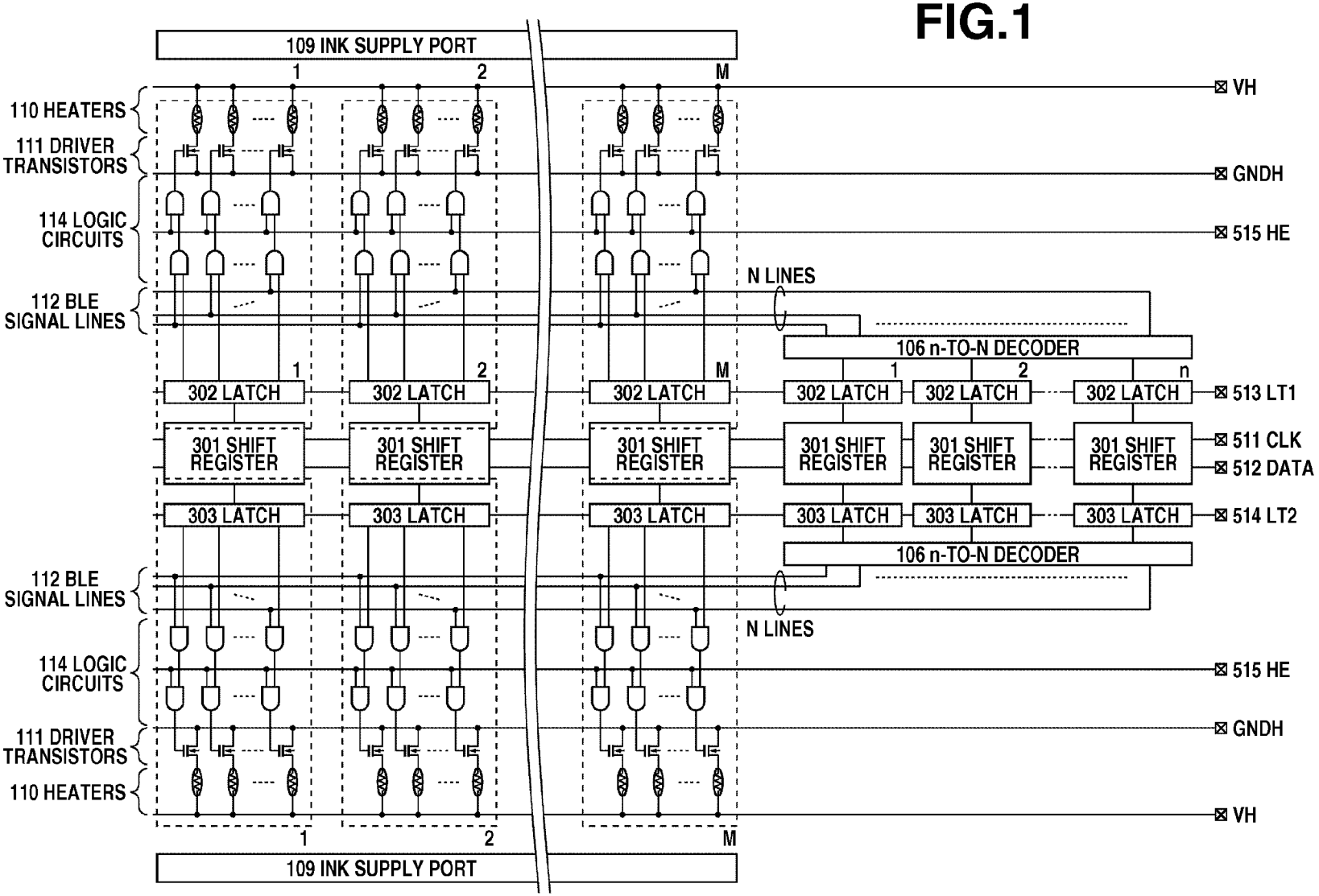
FIG. 1 is a circuit diagram illustrating circuits disposed between supply ports according to a first exemplary embodiment of the present invention.

FIG. 1 is a circuit diagram illustrating circuits disposed between adjacent supply ports formed on a liquid discharge head substrate according to a first exemplary embodiment of the present invention. Each shift register 301 is a 1-bit shift register configured to serially transfer and store recording data in synchronization with a clock signal CLK 511 supplied from a printer main body. Latch circuits 302 and 303 each hold data input to the shift register 301 as parallel data according to a latch signal (LT1, LT2) 513, 514.

First, heater arrays for applying discharge energy to liquid supplied from the upper supply port 109, as viewed in FIG. 1, and circuits for the heater arrays are described below. The heaters 110 are divided into a plurality of groups in units of a predetermined number of heaters, that is, M groups each of which includes N heaters. The units, in which the heaters 110 are divided into groups, correspond to the units on which time-division driving is performed. Although the groups can simultaneously be driven, only one heater can be driven in each group. Similarly, driver transistors 111 are divided into M groups each of which includes N driver transistors. Also, logic circuits 114 are divided into M groups each of which includes N logic circuits. The latch circuits 302 respectively correspond to the groups one-on-one. That is, M latch circuits 302 are disposed. The drive circuits according to the present embodiment include the driver transistors 111, the logic circuits 114, and block enable (BLE) signal lines 112. The above-described circuit configuration is similarly applied to the heater arrays corresponding to the lower supply port 109, as viewed in FIG. 1. Thus, the description of the heater arrays corresponding to the lower supply port 109 is omitted herein.

Each shift register 301 is shared by an associated pair of the upper group and the lower group. Thus, M shift registers 301 are disposed according to the present embodiment. Additionally, the present embodiment includes n shift registers in addition to the M shared shift registers. Accordingly, the present embodiment includes a total of M+n shared shift registers. The n 1-bit shift registers can be united as one shift register. Also, the n latch circuits respectively corresponding to the shift registers can be united as one latch circuit.

The first shift register sends signals to the second shift register and an adjacent first pair of latch circuits. The second shift register sends signals to the third shift register and an adjacent second pair of latch circuits. Subsequently, similarly, M+n shift registers 301 and latch circuits 302 and 303 are serially connected.

M shift registers of the M+n shift registers store 1-bit data respectively corresponding to the groups (1 to M) and transfer the data to the latch circuits 302 and 303. Also, n shift registers store signals to be input to the n-to-N decoder 106 and transfers the signals to the latch circuits 302 and 303. n data are converted by the n-to-N decoder 106 into a signal for selecting one of N heaters included in each group.

Similarly, the present embodiment includes n×2 latch circuits in addition to the M×2 latch circuits (302, 303) for receiving signals from the shift registers. Thus, the present embodiment includes a total of (M+n)×2 latch circuits. The latch circuits respectively corresponding to the groups (1 to M) send signals to the associated logic circuits 114. The latch circuits (1 to n) send signals to the n-to-N decoder 106.

The sharing of a shift register facilitates a reduction in the distance between adjacent supply ports. Also, the configuration of the present embodiment is not limited to that in which a 1-bit shift register is provided in each group. The configuration thereof may be adapted so that shift registers of a plurality of bits and latch circuits are provided every a plurality of groups.

An operation of the drive circuit illustrated in FIG. 1 will now be described with reference to patterns of input signals illustrated in FIGS. 3A and 3B.

Figure 3A:
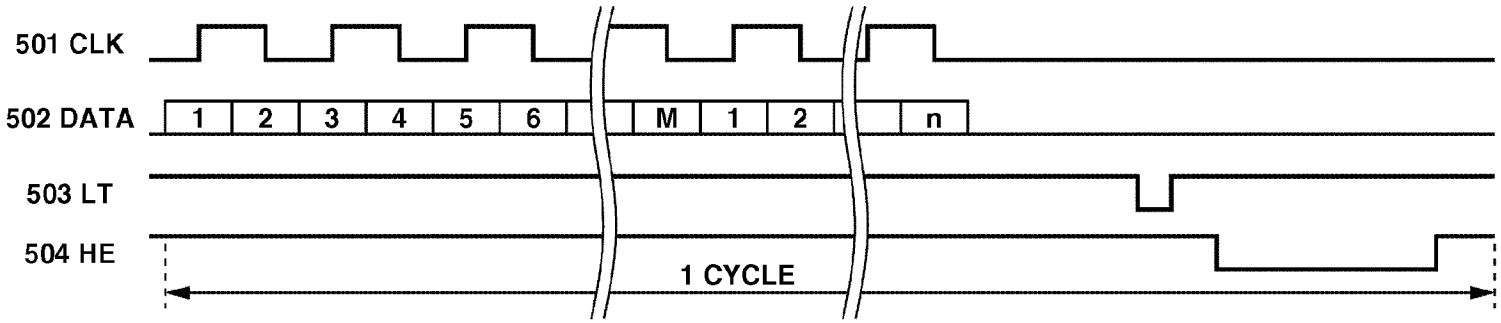
FIG.3A (PRIOR ART)
FIG. 3A is a timing chart illustrating patterns of signals input to a conventional head.

First, the patterns of input signals in the conventional drive circuit illustrated in FIG. 3A are described below. In (M+n)-bit data 502 corresponding to image data, the first part, i.e., M-bit data, is used to select a group on which time-division driving is performed. The second part, i.e., n-bit data, is used to select a heater in each group.

The (M+n)-bit data 502 is input to the shift registers in synchronization with a clock signal (CLK) 501. The input data is held by the latch circuits in response to a latch signal (LT) 503. In the case of low-active latch circuits, data is latched when the level of the latch signal is low. More specifically, a total of M bits of data are held by the latch circuits (1 to M). A total of n bits of data are held by the latch circuits (1 to n). A total of n bits of data held by the latch circuits (1 to n) are held by a decoder 106. Then, n binary input bits are converted by the decoder 106 into N binary output bits. The output of the decoder 106 is used to select one of N BLE signal lines 112. Electric current is supplied to a heater which is selected according to a logical product of the signal output from the decoder 106 and the data 502 at a point in time at which the level of a heat enable (HE) signal 504 becomes low (or ON-level).

The above-described operation is performed in one cycle. Then, the operation is repeated in N cycles. Thus, all of M×N heaters can be selected by performing time-division driving of M heaters in N cycles.

Figure 3B:
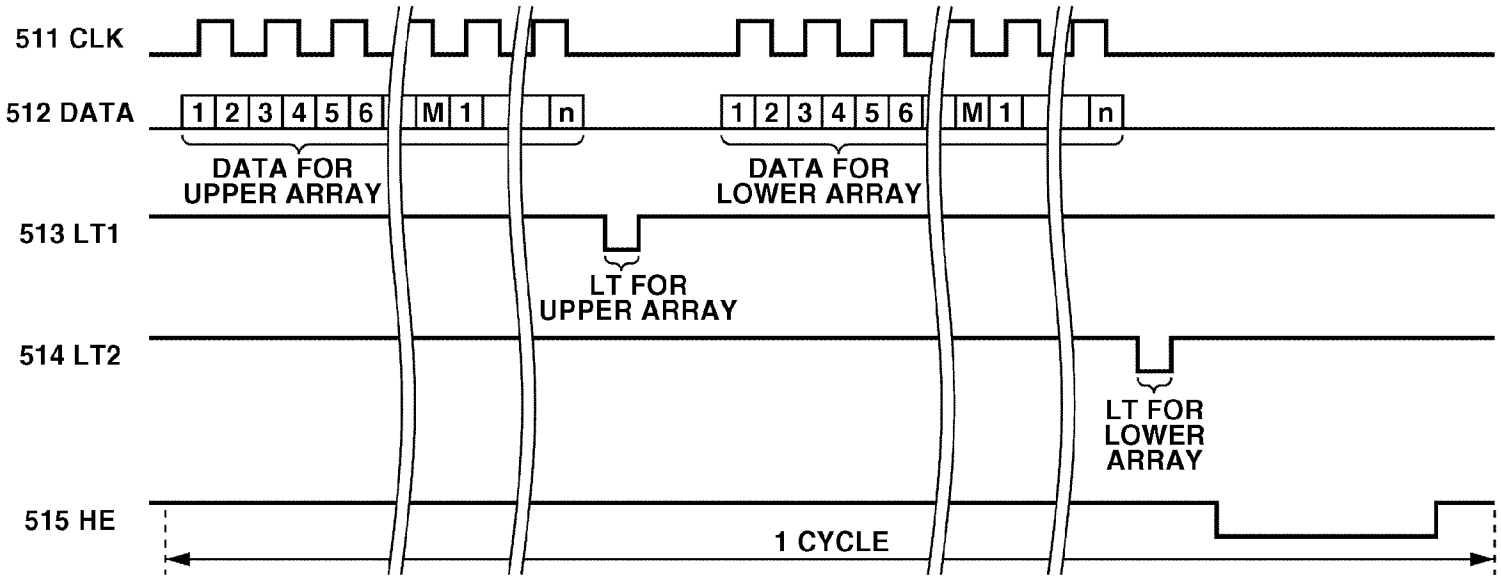
FIG. 3B is a timing chart illustrating patterns of signals input to a head according to the first exemplary embodiment of the present invention.

FIG. 3B illustrates input signal patterns according to the present embodiment.

As illustrated in FIG. 3B, in the present embodiment, (M+n)-bit data 512 and clock signal (CLK) 511 are input twice in one cycle. A period of time from the completion of inputting of the data 512 and the clock signal (CLK) 511 to a moment at which the level of the latch signal (LT1, LT2) 513, 514 becomes low (corresponding to ON-level) is assumed to be a period (about 40 nanoseconds (ns)) sufficient for storing the data in the shift register and transmitting the data to the latch circuit. An interval between the first input of the data 512 and the clock signal (CLK) 511 and the second input thereof is assumed to be a period (about 150 ns) sufficient for inputting the latch signal LT1 and latching the data 512. (M+n)-bit data input to the shift registers 301 for the first time according to the clock signal 511 is held by the latch circuits 302 in the upper array, as viewed in FIG. 1, according to the latch signal (LT1) 513. (M+n)-bit data input to the shift registers 301 for the second time according to the clock signal 511 is held by the latch circuits 303 in the lower array, as viewed in FIG. 1, according to the latch signal (LT2) 514. Subsequently, the HE signal 515 is input to the logic circuits 114. The logic circuits 114 supply electric current to the selected heaters 110 in both arrays at a period of time at which the level of the HE signal 515 becomes low (corresponding to ON-level). In the present embodiment, the HE signal 515 is shared by the circuits in both arrays. However, different HE signals can be input to the circuits in two arrays, respectively. For example, in a case where the two arrays differ in the amount of ink discharge or in temperature, it is useful to adjust energy applied thereto by causing the pulse widths of the HE signals 515 to vary with the amount of ink discharge or the temperature.

As described above, data for two heater arrays is input in series to the shift registers 301. The data held by the shift registers 301 is distributed to the circuits on both sides of the shift registers 301 at a desired timing according to the latch signals (LT1) 513 and (LT2) 514. Consequently, the shift register 301 can be shared by two sets of circuits, i.e., the upper and lower array circuits, as viewed in FIG. 1. Additionally, given heaters of adjacent two arrays can simultaneously be driven.

To set the same frequency, at which ink is discharged, as that in the conventional apparatus, it is useful to set a term of one cycle equal to that of one cycle employed in the conventional apparatus. Thus, it is useful that the frequencies of the signals CLK and DATA are twice or more of those of the conventional apparatus. To that end, it is necessary to transfer the signals CLK and DATA at high speed. An example of the technique for implementing such high speed transfer of the signals CLK and DATA is a low voltage differential signaling (LVDS) technique.

Figure 2:
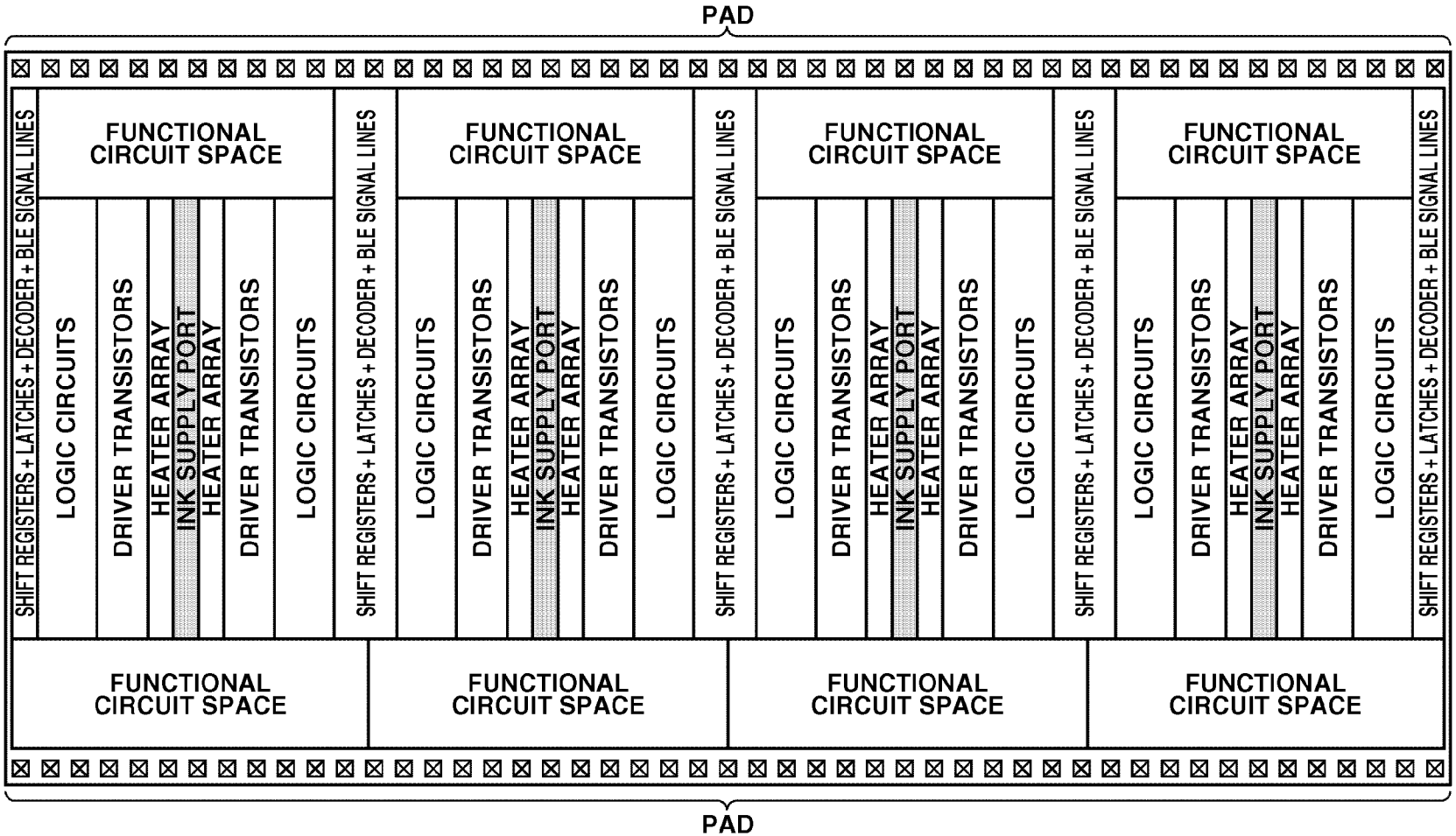
FIG. 2 is a diagram illustrating a layout of circuits according to the first exemplary embodiment of the present invention.

FIG. 2 illustrates an example of a layout of the circuits provided on the element substrate as illustrated in FIG. 1 according to the first exemplary embodiment of the present invention. As illustrated in FIG. 2, the latch circuits, the drive circuits, the recording element array, and the supply port adapted to supply liquid to the recording elements are disposed on each side of the shift registers in order from the shift registers. FIG. 2 illustrates the layout of the circuits disposed between the adjacent supply ports in a case where two arrays of M×N heaters are disposed on both sides of the elongated supply port 109, respectively, to be symmetrical with respect to the supply port 109. As illustrated in FIG. 2, the heater array 110 including a plurality of heaters, the driver transistors 111, the logic circuits 114, the BLE signal lines 112, the latch circuits 303, and the shared shift registers 301 are disposed on each side of the supply port in order from the supply port.

It is to be noted that only the circuits disposed between the supply ports have such a configuration. The shift registers provided respectively on both ends of the element substrate according to the present embodiment have a circuit configuration similar to that illustrated in FIG. 10.

As described above, in a circuit configuration for driving recording elements, the function of a shift register is shared by two arrays of recording elements disposed between a pair of adjacent supply ports. Thus, the absolute number of circuit elements can be decreased. The area of the element substrate can also be reduced. A circuit, such as a constant current circuit, for implementing high image quality can be disposed in an empty space occurring in the element substrate. Additionally, a latch circuit relating to driving of recording elements disposed between a pair of adjacent supply ports is provided for each array of recording elements, thus enabling the simultaneous driving of the adjacent arrays of recording elements.

Second Exemplary Embodiment

While, in the first exemplary embodiment, a heater array discharges the same amount of ink droplets, a heater array can discharge different amounts of ink droplets according to a second exemplary embodiment of the present invention. In a case where a head forms an image with only small droplets to implement high quality printing, it is necessary to discharge a larger number of droplets, as compared with a case of forming an image with large droplets. Thus, a printing speed is reduced. Therefore, an image is formed by using discharge ports and heater arrays, which differ in amount of discharge droplets from one another, to mix large droplets and small droplets. Consequently, a high quality image with high tonability is obtained. A head with a high printing speed can be obtained.

However, in a case where discharge ports, which provide various amounts of discharged droplets, coexist in a single head, individual circuits respectively corresponding to different amounts of discharged droplets are needed. Consequently, the cost and the size of the substrate increase.

Figure 9:
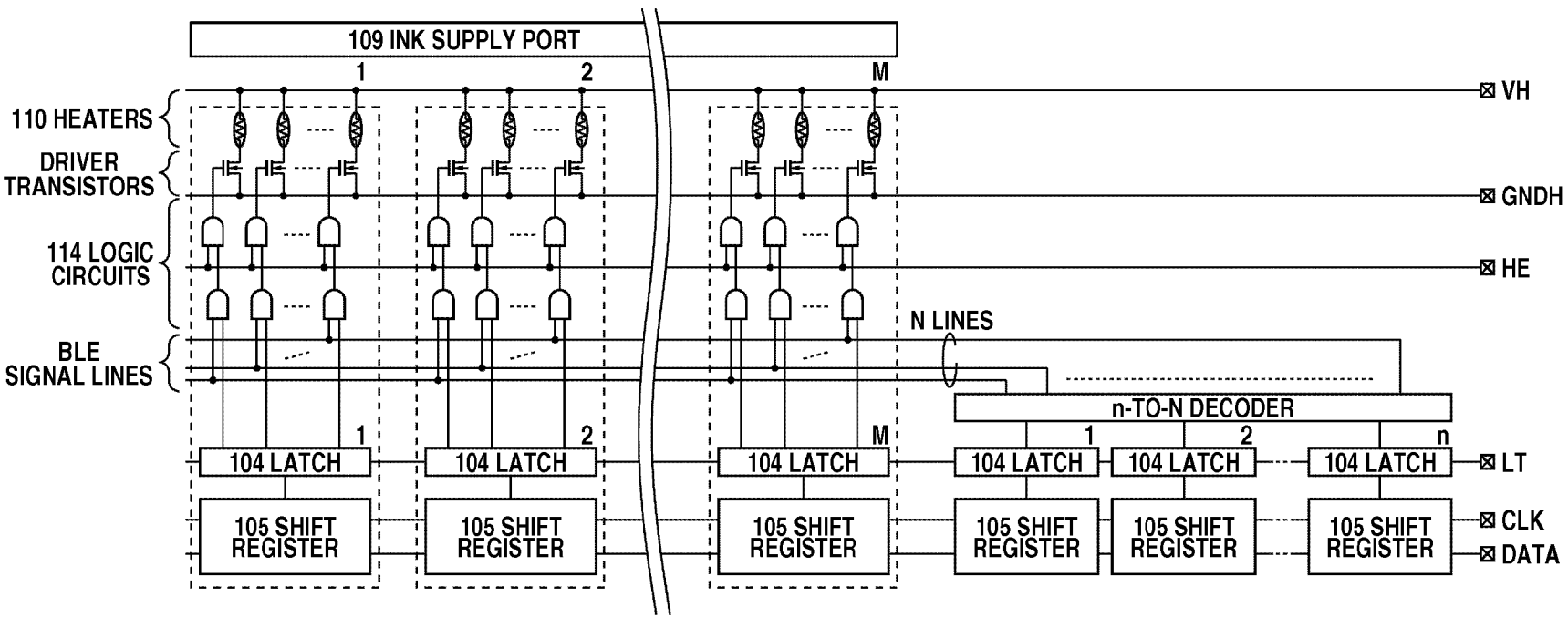
FIG.9 (PRIOR ART)
FIG. 9 is a circuit diagram illustrating circuits of a conventional head.
Figure 10:
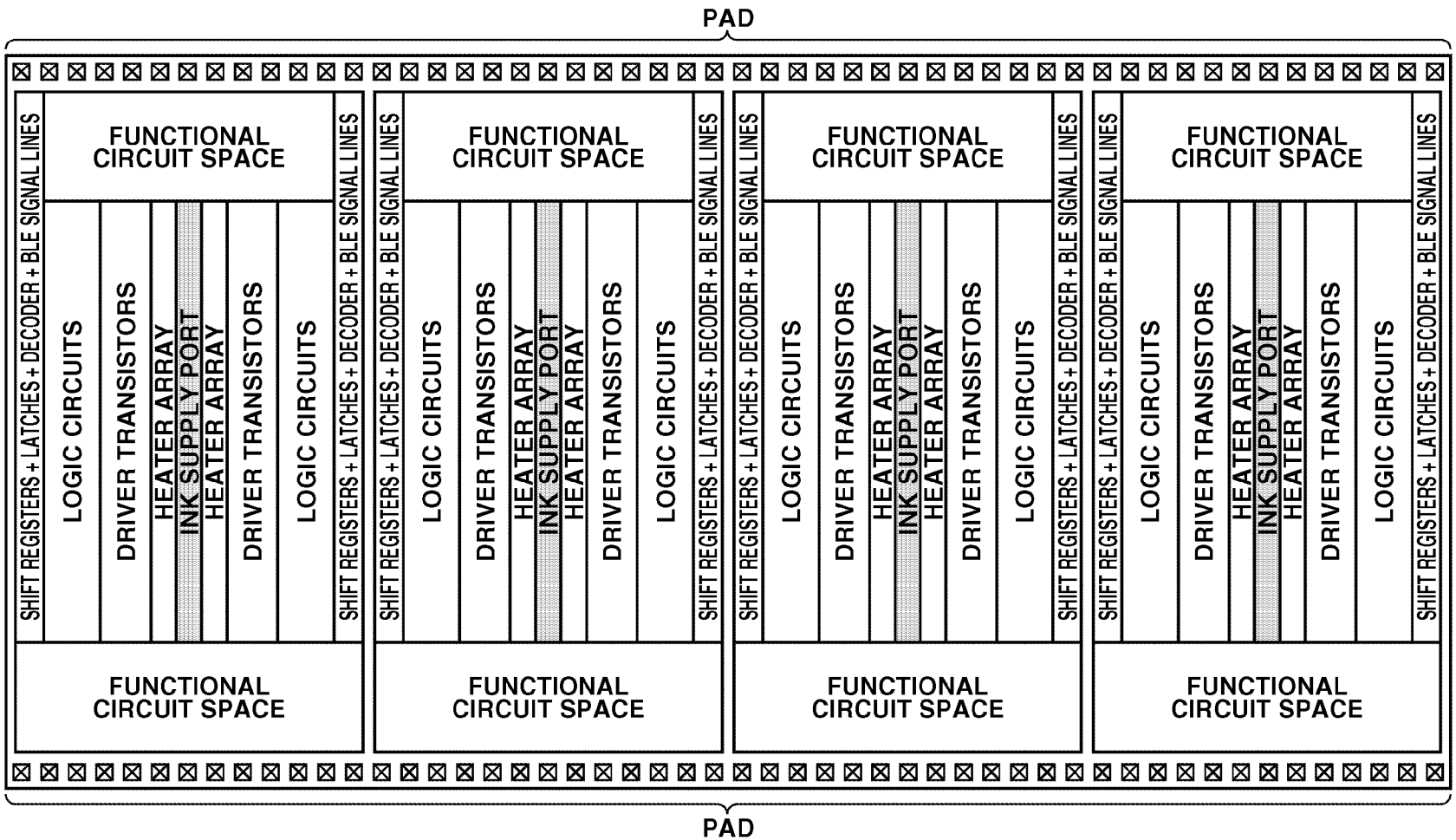
FIG.10 (PRIOR ART)
FIG. 10 is a diagram illustrating a layout of circuits of the conventional head.

In a case where the heater arrays corresponding to large and small droplets are applied to the conventional circuit configuration illustrated in FIGS. 9 and 10, all of M droplets, which can simultaneously be discharged, are large droplets. Alternatively, all of the M droplets are small droplets. In each of the groups on which the time-division driving is performed, N heaters are arranged in a regular pattern so that a heater corresponding to the large droplet and a heater corresponding to the small droplet are alternately disposed. Among the N heaters, which of the heaters is turned on is selected through the N BLE signal lines 112 in conjunction with all of the groups. Thus, the large droplets cannot be discharged simultaneously with the discharge of the small droplets. Accordingly, this is disadvantageous in forming a highly gradational image at high speed.

Figure 4:
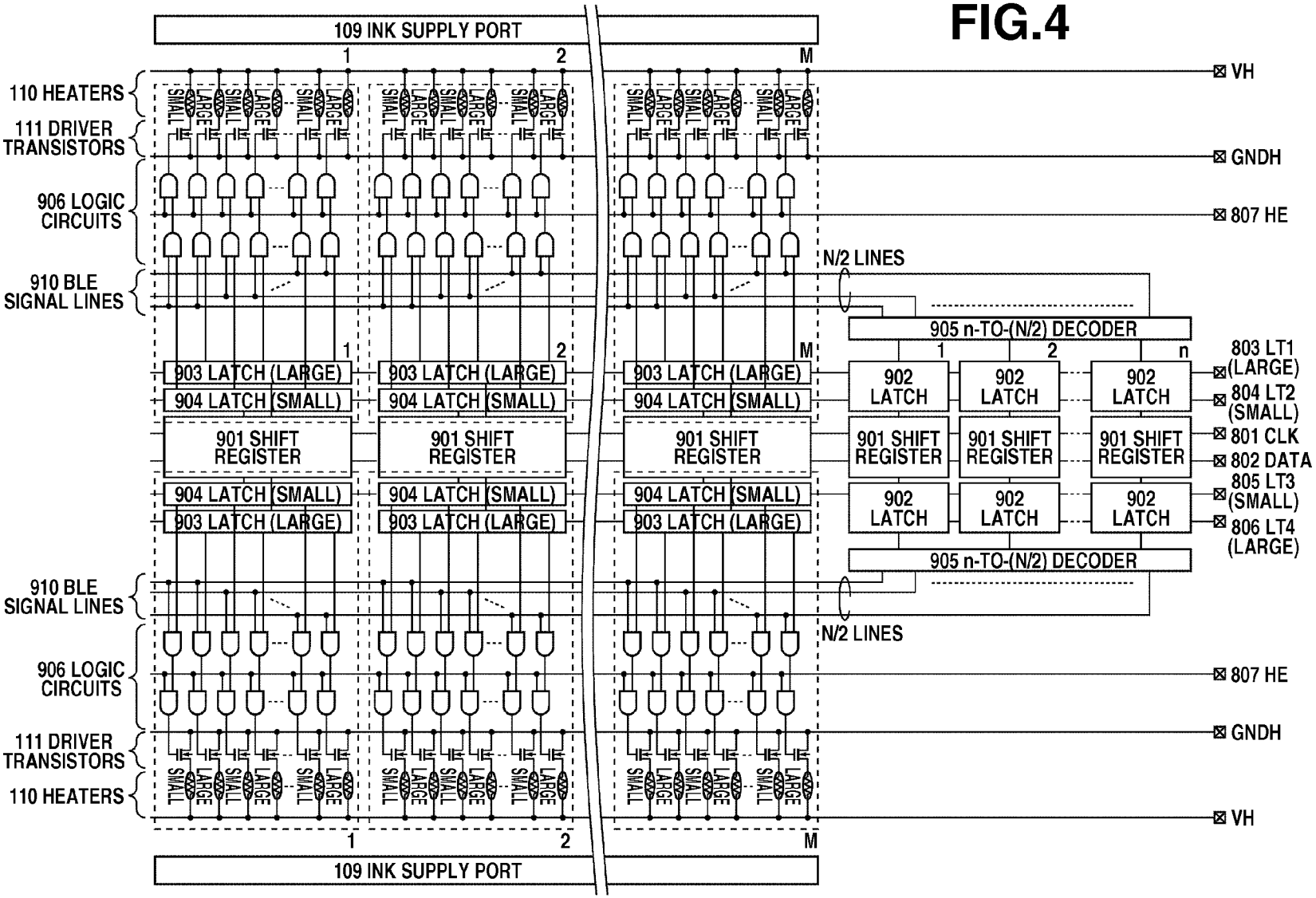
FIG. 4 is a circuit diagram illustrating circuits disposed between supply ports according to a second exemplary embodiment of the present invention.

FIG. 4 illustrates circuits disposed between adjacent supply ports formed on the substrate according to the second exemplary embodiment. The description of a circuit element, whose driving operation in response to the input signal is similar to that of a corresponding circuit element of the first exemplary embodiment, is omitted.

In the present embodiment, a heater for a large droplet and a heater for a small droplet are alternately disposed. Accordingly, a large droplet and a small droplet can simultaneously be discharged. As illustrated in FIG. 4, in each of the groups on which the time-division driving is performed, one heater for a large droplet and one heater for a small droplet are driven through one BLE signal line 910. Thus, the number of the BLE signal lines is reduced to one-half of that of the conventional apparatus (i.e., N/2). According to the present embodiment, a heater for a large droplet and a heater for a small droplet, which are adjacent to each other, are driven through one BLE signal line 910. Such a configuration of paired adjacent heaters respectively corresponding to a large droplet and a small droplet facilitates wiring connection and control of image processing.

In a case where a heater array corresponding to the upper supply port, as viewed in FIG. 4, is driven, which of the heater for a large droplet and the heater for a small droplet is driven is determined by a combination of the latch circuit 903 and the latch signal (LT1) 803 for a large droplet and a combination of the latch circuit 904 and the latch signal (LT2) 804 for a small droplet. Similarly, in a case where a heater array corresponding to the lower supply port, as viewed in FIG. 4, is driven, which of the heater for a large droplet and the heater for a small droplet is driven is determined by a combination of the latch circuit 903 and the latch signal (LT1) 806 for a large droplet and a combination of the latch circuit 904 and the latch signal (LT2) 805 for a small droplet.

Figure 5:
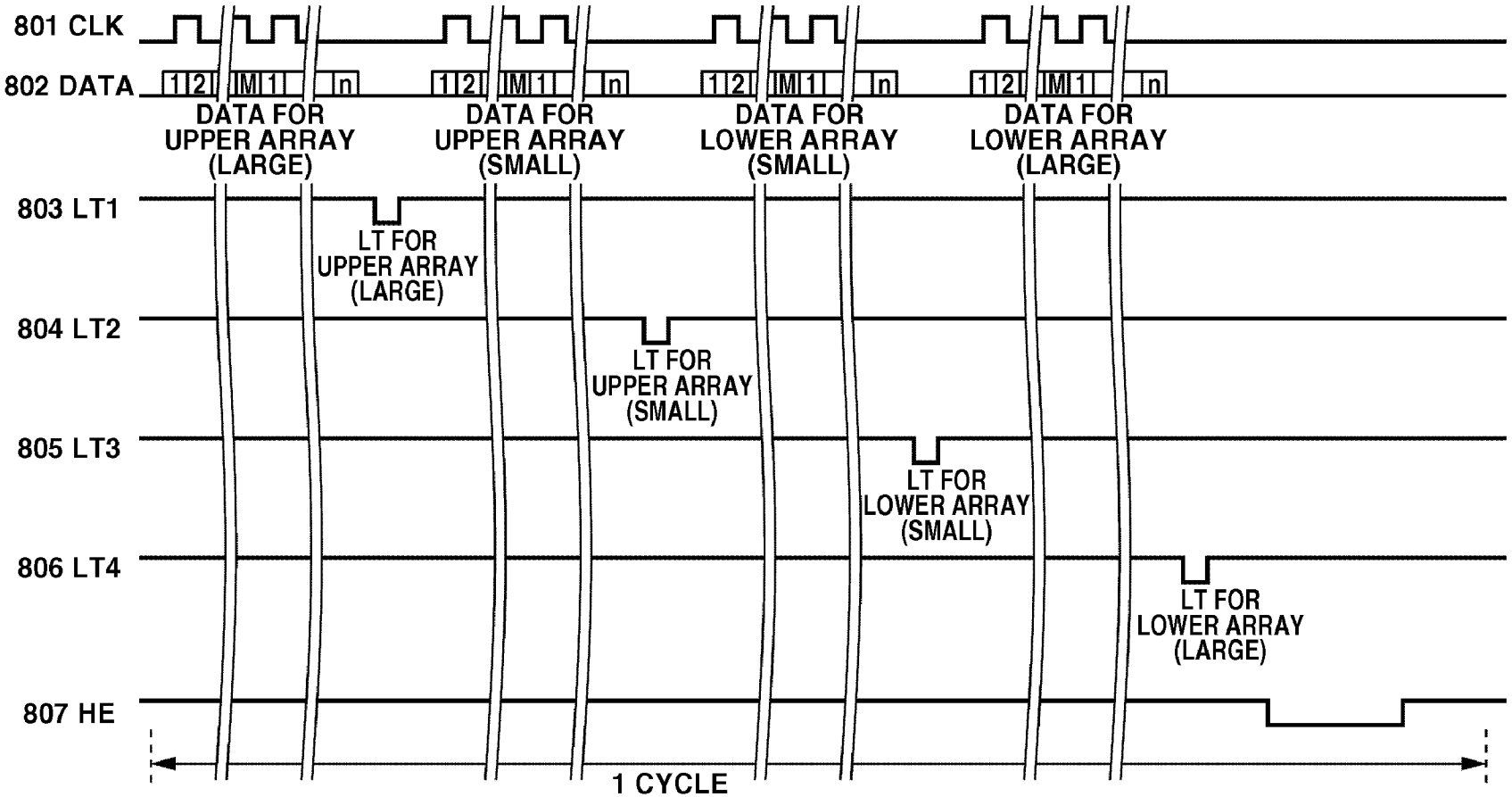
FIG. 5 is a timing chart illustrating patterns of signals input to a head according to the second exemplary embodiment of the present invention.

FIG. 5 illustrates patterns of input signals in the second exemplary embodiment of the present invention.

Similar to the first exemplary embodiment, (M+n)-bit data 802 and a clock signal (CLK) 801 are input to a shift register 901. In the second exemplary embodiment, signals output from one shift register 901 are received by four latch circuits. Thus, DATA signals 802 are input four times in one cycle. Data for two arrays of heaters are input in one cycle in the first exemplary embodiment, as illustrated in FIG. 3B. However, in addition to the data for two arrays of heaters, in the second exemplary embodiment, data corresponding to a large droplet and a small droplet are input thereto. That is, four kinds of data are input to the shift register 901. More specifically, the four kinds of data include large droplet data for the upper heater array, small droplet data for the upper heater array, large droplet data for the lower heater array, and small droplet data for the lower heater array. The large droplet data for the upper heater array, the small droplet data for the upper heater array, the small droplet data for the lower heater array, and the large droplet data for the lower heater array are input to and held by the latch circuits 903 and the latch circuits 904, disposed for the upper and lower heater arrays, in response to latch signals 803, 804, 805, and 806, respectively. In a state in which all of the latch circuits hold the data, a heat enable (HE) signal 807 is input to a logic circuit 906 to obtain a logical product. This enables simultaneous driving of the heater for a small droplet and the heater for a large droplet.

In the same cycle, large droplet data and small droplet data for the same heater array should not belong to the same group with respect to the M-bit data used to select the groups on which the time-division driving is performed. If two kinds of data respectively corresponding to a large droplet and a small droplet belongs to the same group with respect to the group selection data, two heaters are simultaneously driven in the same group on which the time-division driving is performed. However, only one heater can be driven in the same group on which the time-division driving is performed. In a case where two heaters are simultaneously driven in the same group, the driving cannot normally be achieved due to influence of a voltage drop caused by parasitic impedance of power supply wires and due to a limit to capability of supplying electric current. However, large droplet data and small droplet data for the same heater array can belong to the same group with respect to the n-bit data (data representing the heaters on which the time-division driving is performed in each group) in view of forming high-quality images.

According to the second exemplary embodiment, one heat enable (HE) signal 807 is used to discharge large droplets and small droplets. Different heat enable signals can be provided corresponding to the large droplet and the small droplet. Thus, energy corresponding to the amount of discharged droplets can be applied. This is advantageous in energy saving and in increasing the life of the heaters.

In the foregoing description, the control of an amount of discharged large droplets and an amount of discharged small droplets has been described. However, the apparatus can provide two or more kinds of amounts of discharged droplets by increasing the number of inputting data in each cycle and also increasing the number of latch circuits and latch signals.

The layout of circuits provided on the substrate according to the second exemplary embodiment can be described with reference to FIG. 2, similar to the layout of circuits provided on the substrate according to the first exemplary embodiment. Thus, a similar description is omitted. The second exemplary embodiment differs from the first exemplary embodiment in that the heater array 110 includes a heater for a large droplet and a heater for a small droplet alternately arranged in the longitudinal direction of the supply port, and that the number of BLE signal lines is N/2. Also, in the second exemplary embodiment, the latch circuit 903 for a large droplet and the latch circuit 904 for a small droplet are provided in each of the groups on which the time-division driving is performed. Additionally, only the circuits disposed between the supply ports have such a configuration. The shift registers provided respectively on both ends of the element substrate according to the second exemplary embodiment have a circuit configuration similar to that of the conventional apparatus.

Thus, in a case where the element substrate includes a recording element array in which recording elements differing in amount of discharged droplets are arranged in a regular pattern, latch circuits corresponding to the kinds of droplets can be provided for each array, so that a plurality of types of recording elements differing in amount of discharged droplets can simultaneously be driven. Consequently, a highly gradational image can be formed at high speed with a minimum circuit configuration.

Third Exemplary Embodiment

A liquid discharge apparatus according to a third exemplary embodiment can be driven at higher speed by simultaneously performing signal transfer and ink discharge.

As illustrated in FIG. 3A, a data signal 502 in the conventional apparatus is held by the latch circuit at timing at which the latch signal 503 is input. Subsequently, the level of the HE signal 504 is set to be low (corresponding to ON-level) Then, electric current flows in the heater for a time corresponding to a pulse width of the HE signal 504 to discharge ink. A method for driving the head at higher speed under such control is to input the next signal DATA while supplying electric current to the heater (during a period when the level of the HE signal 504 is low (corresponding to ON-level). The cycle of discharge of ink corresponding to one nozzle can considerably be reduced. Also, both of a high recording speed and a high-quality recording image can concurrently be implemented.

However, when the above-described driving is performed with the configuration according to the first exemplary embodiment, the latch circuit is driven while electric current is supplied to the heater. Thus, the latch circuit may update data, thus causing erroneous ink discharge.

Figure 11:
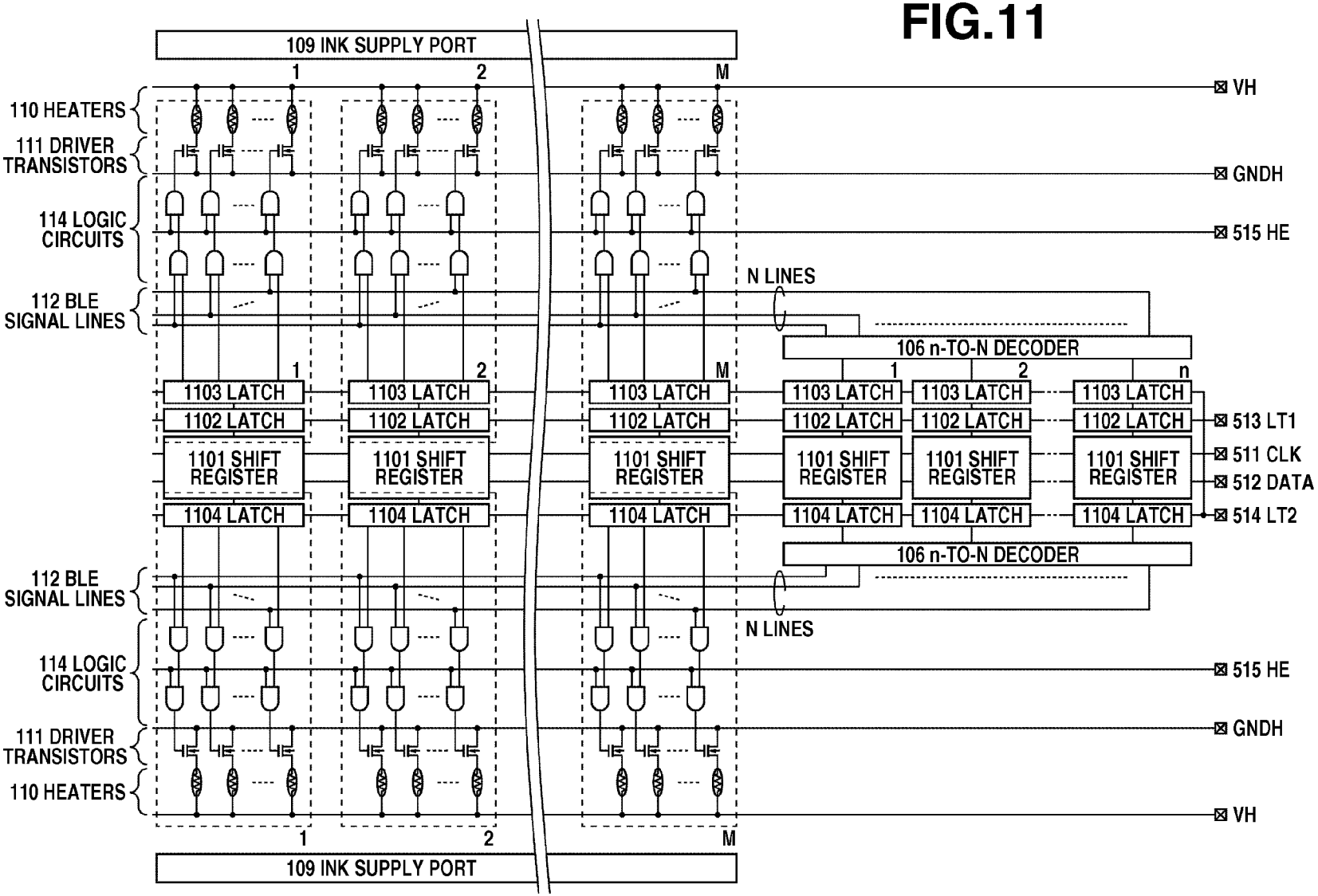
FIG. 11 is a circuit diagram illustrating circuits disposed between supply ports according to a third exemplary embodiment of the present invention.

FIG. 11 illustrates the configuration of circuits disposed between the supply ports according to the third exemplary embodiment. The configuration illustrated in FIG. 11 can be obtained by adding a latch circuit 1103 to each of the blocks 1 to M at one of the upper array and the lower array (the upper array in this case) of the configuration of the first exemplary embodiment. A shift register 1101, a latch circuit 1102, and a latch circuit 1103 are connected in series. The description of components of the third exemplary embodiment, which are similar to those of the first exemplary embodiment, is omitted.

Figure 12:
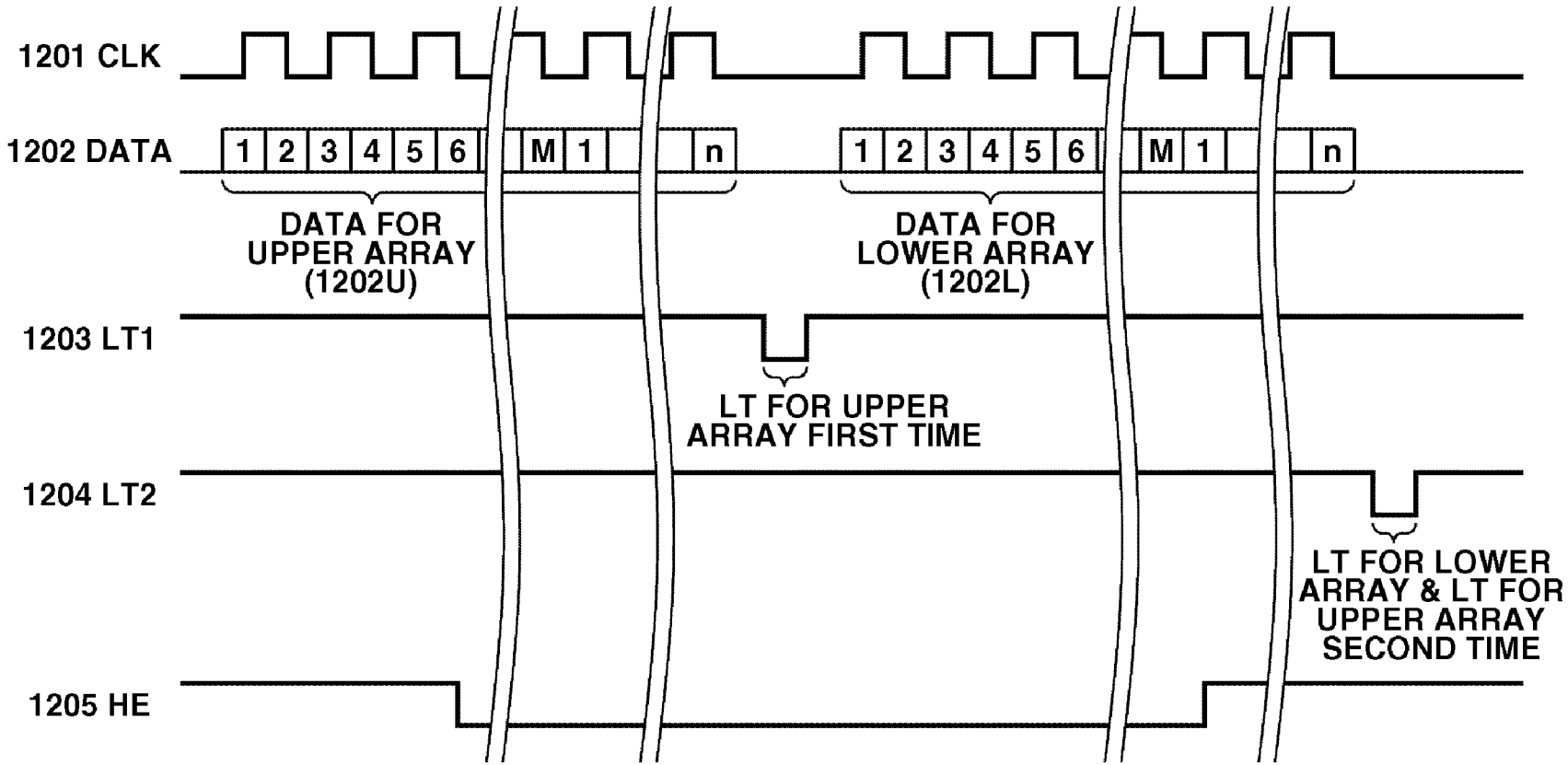
FIG. 12 is a timing chart illustrating patterns of signals input to a head according to the third exemplary embodiment of the present invention.

FIG. 12 illustrates patterns of input signals in the third exemplary embodiment of the preset invention.

A clock signal 1201 and data 1202 are input to the shift resister 1101 from a CLK terminal 511 and a DATA terminal 512 shown in FIG. 11, respectively. A latch signal 1203 (LT1) shown in FIG. 12 is input to the latch circuit 1102 from an LT1 terminal 513 shown in FIG. 11. A latch signal 1204 (LT2) shown in FIG. 12 is input to latch circuits 1104 and 1103 from an LT2 terminal 514 shown in FIG. 11. An HE signal 1205 shown in FIG. 12 is input to an HE terminal 515 shown in FIG. 11. The clock signal 1201, the data 1202, the latch signals 1203 (LT1) and 1204 (LT2), and operating timing thereof are similar to those of the first exemplary embodiment.

When (M+n)-bit data is sent for the first time, a latch pulse of the latch signal 1203 (LT1) having a low level (corresponding to ON-level) is input. Timing at which the level of the latch signal 1203 (LT1) is low (corresponding ON-level) is similar to that in the first exemplary embodiment. This timing (i.e., the timing at which the signal level in the latch circuit becomes low since the end of the data) is determined by a time (about 40 ns) sufficient to store the data in the shift register and to transfer the data to the latch circuit.

The level of the HE signal 1205 can be set to be low (corresponding to ON-level) in a range in which the level of the latch signal 1204 (LT2) is high (corresponding to OFF-level) However, there is a necessary margin of 200 ns from timing at which the signal level in the latch circuit is changed from high (corresponding to OFF-level) to low (corresponding to ON-level) to timing at which the level of the HE signal is changed to low (corresponding to ON-level). Also, there is a necessary margin of about 50 ns from timing at which the signal level in the latch circuit is changed from low (corresponding to ON-level) to high (corresponding to OFF-level) to timing at which the level of the HE signal is changed to low (corresponding to ON-level). This is determined by response times of the latch circuits 1103 and 1104, the logic circuit 114, and the driver transistor 111.

Next, an operation of the drive circuits shown in FIG. 11 is described with reference to the patterns of input signals illustrated in FIG. 12. Upon completion of inputting (M+n)-bit data 1202U for the upper array to the shift register 1101 in synchronization with the clock signal 1202, the level of the latch signal 1203 (LT1) becomes low (corresponding to ON-level) When the latch circuit 1102 is turned on, the data 1202U for the upper array is held by the latch circuit 1102. Subsequently, data 1202L for the lower array is similarly input to the shift register 1101 in synchronization with the clock signal 1201. Upon completion of inputting the data 1202L for the lower array to the shift register 1101, the level of the latch signal 1204 (LT2) becomes low (corresponding to ON-level). When the latch circuits 1103 and 1104 are turned on, the latch circuit 1103 takes in and holds the data 1202U for the upper array held in the latch circuit 1102. The latch circuit 1103 then transfers the data 1202U for the upper array to the logic circuit 114 for the upper array. The latch circuit 1104 takes in and holds data 1202L for the lower array stored in the shift register 1101. The latch circuit 1104 then transfers the data 1202L for the lower array to the logic circuit 114 for the lower array. When a driving operation is performed up to this stage, the next discharge data is input to the shift register 1101. Subsequently, a circuit operation similar to the above-described operation is performed. The level of the HE signal 1205 becomes low (corresponding to ON-level) until the next data is transferred to the logic circuit 114 (the level of the next latch signal 1204 (LT2) becomes low (corresponding to ON-level)). Thus, ink discharge and a circuit driving operation for the next ink discharge are simultaneously performed.

As described above, in the third exemplary embodiment, the logic circuits 114 for both the upper array and the lower array are driven only at timing at which the level of the latch signal 1204 (LT2) becomes low (corresponding to ON-level). Therefore, the logic circuits 114 does not operate while a heater current flows. Accordingly, no erroneous discharge operation is caused while ink is discharged. Although one latch signal 1204 is input to two latch circuits 1103 and 1104 in the third exemplary embodiment, separate signals similar to the latch signal 1204 can be input to the respective latch circuits 1103 and 1104.

The layout of the circuits provided on the substrate according to the third exemplary embodiment can be described with reference to FIG. 2, similar to the first exemplary embodiment. Thus, a similar description of the layout is omitted. The layout area of each of the latch circuits 1102 to 1104 is equal to or less than one-half of that of the shift register 1101. Thus, even when two latch circuits are mounted on the substrate, the area of the substrate is smaller than that of the substrate of the conventional head shown in FIG. 10.

Thus, according to the third exemplary embodiment, an ink discharging frequency can be increased by disposing two latch circuits on one side of the shift register. Consequently, both of a low cost apparatus and a high-speed and high-quality recording apparatus can be concurrently implemented.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-175569 filed Jun. 26, 2006, which is hereby incorporated by reference herein in its entirety.

What is claimed is:

1. A liquid discharge head substrate comprising:

a recording element array including a plurality of recording elements;

a supply port adapted to supply liquid to the plurality of recording elements;

shift registers configured to serially receive input recording signals for driving the plurality of recording elements;

latch circuits configured to hold in parallel the recording signals input to the shift registers; and drive circuits configured to drive the plurality of recording elements based on signals output from the latch circuits, wherein the latch circuits, the drive circuits, the recording element array, and the supply port are disposed on each side of the shift registers in order from the shift registers.

2. The liquid discharge head substrate according to claim 1, wherein the recording element array is divided into a plurality of groups in units of a predetermined number of recording elements, wherein the groups respectively corresponding to pairs of the recording element arrays constitute a plurality of pairs of groups, wherein the shift registers are configured to receive a signal for selecting between the groups and each of the shift registers is provided for each pair of groups, wherein each of the latch circuits is provided for each of the groups, and wherein the liquid discharge head substrate further comprises a decoder configured to generate a signal for selecting one of the recording elements included in each of the groups.

3. The liquid discharge head substrate according to claim 1, wherein each of the shift registers is connected to two or more of the latch circuits.

4. The liquid discharge head substrate according to claim 1, wherein the recording element array includes recording elements differing in amount of discharged liquid droplets, and wherein the latch circuits are configured to select between the recording elements differing in amount of discharged liquid droplets.

5. A liquid discharge head comprising:

a liquid discharge head substrate including:

a recording element array including a plurality of recording elements;

a supply port adapted to supply liquid to the plurality of recording elements;

shift registers configured to serially receive input recording signals for driving the plurality of recording elements;

latch circuits configured to hold in parallel the recording signals input to the shift registers; and drive circuits configured to drive the plurality of recording elements based on signals output from the latch circuits, wherein the latch circuits, the drive circuits, the recording element array, and the supply port are disposed on each side of the shift registers in order from the shift registers; and a member including:

a flow path adapted to flow liquid therethrough, the flow path communicating with the supply port; and a discharge port adapted to discharge liquid therefrom.

6. The liquid discharge head according to claim 5, wherein the liquid discharge head substrate includes a plurality of supply ports, and wherein different color inks are supplied to the plurality of supply ports, respectively.

7. A liquid discharge apparatus having a liquid discharge head, the liquid discharge apparatus being configured to send a recording signal to the liquid discharge head and to discharge liquid to a recording medium using the liquid discharge head to perform recording, the liquid discharge head comprising:

a liquid discharge head substrate including:

a recording element array including a plurality of recording elements;

a supply port adapted to supply liquid to the plurality of recording elements;

shift registers configured to serially receive input recording signals for driving the plurality of recording elements;

latch circuits configured to hold in parallel the recording signals input to the shift registers; and drive circuits configured to drive the plurality of recording elements based on signals output from the latch circuits, wherein the latch circuits, the drive circuits, the recording element, and the supply port are disposed on each side of the shift registers in order from the shift registers; and a member including:

a flow path adapted to flow liquid therethrough, the flow path communicating with the supply port; and a discharge port adapted to discharge liquid therefrom.

8. The liquid discharge apparatus according to claim 7, wherein the recording element array is divided into a plurality of groups in units of a predetermined number of recording elements, wherein the groups respectively corresponding to pairs of the recording element arrays constitute a plurality of pairs of groups, wherein the shift registers are configured to receive a signal for selecting between the groups and each of the shift registers is provided for each pair of groups, wherein each of the latch circuits is provided for each of the groups, wherein the liquid discharge head substrate further includes a decoder configured to generate a signal for selecting one of the recording elements included in each of the groups, and wherein the recording signal includes the signal for selecting between the groups and the signal for selecting one of the recording elements included in each of the groups.

* * * * *